United States Patent [19]

Snook

[11] Patent Number: 4,519,303

[45] Date of Patent: May 28, 1985

[54] CHIMNEY LINING SYSTEM INCLUDING FRAME-SUPPORTED MEMBRANE

[75] Inventor: Randolph W. Snook, Pittsburgh, Pa.

[73] Assignee: Crown Union, Inc., Pittsburgh, Pa.

[21] Appl. No.: 478,309

[22] Filed: Mar. 24, 1983

[51] Int. Cl.[3] ..... E04H 12/28

[52] U.S. Cl. ..... 98/58; 98/60; 110/184

[58] Field of Search ..... 98/58, 60; 110/184; 126/307 R

[56] References Cited

U.S. PATENT DOCUMENTS

| | | | |
|---|---|---|---|
| 3,537,411 | 11/1970 | Roy | 98/60 X |
| 3,782,266 | 1/1974 | Snook | 98/58 |
| 3,812,771 | 5/1974 | Yokoyama et al. | 98/60 |
| 4,265,166 | 5/1981 | Parker et al. | 98/58 |
| 4,437,090 | 5/1984 | Hanson | 98/58 X |

FOREIGN PATENT DOCUMENTS

| | | | |
|---|---|---|---|
| 1227632 | 10/1966 | Fed. Rep. of Germany | 98/58 |
| 1177258 | 1/1970 | United Kingdom | 98/58 |
| 1399761 | 7/1975 | United Kingdom | 98/58 |
| 1584399 | 2/1981 | United Kingdom | 110/184 |
| 2099972 | 12/1982 | United Kingdom | 98/58 |

*Primary Examiner*—Harold Joyce

*Attorney, Agent, or Firm*—Cushman, Darby & Cushman

[57] ABSTRACT

A chimney lining system is disclosed, in which a membrane, typically 60 mils thick, of corrosion-resistant alloy material is suspended within an external skeletal frame-work of less-expensive carbon steel. Hangers provide for radial expansion of the liner. However, inward movement of the hangers is restrained. Axially spaced circumferential corrugations located midway axially between where two membrane sections are stiffened, joined and connected to the framework, provide for axial expansion. The external framework is disposed within a tubular concrete chimney column. At several levels, grillages support the external framework from the wall of the chimney column. The structural grillages may bear upon load cells equipped to signal the build-up of sludge on the interior of the liner.

32 Claims, 20 Drawing Figures

Fig. 3
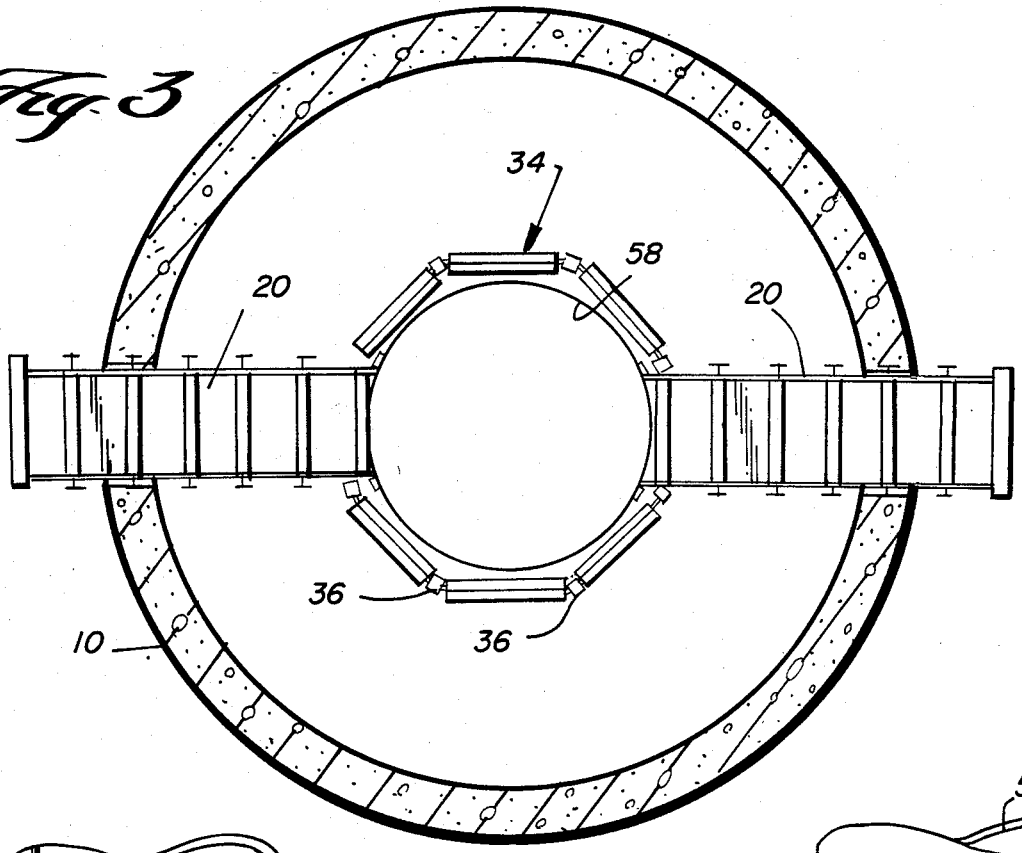
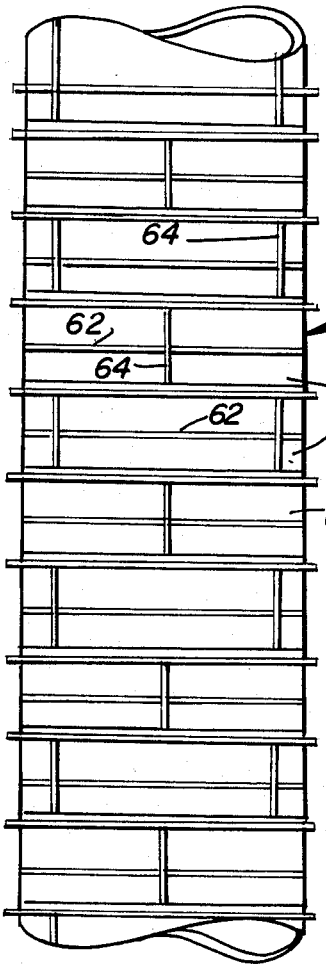
Fig. 4
Fig. 5
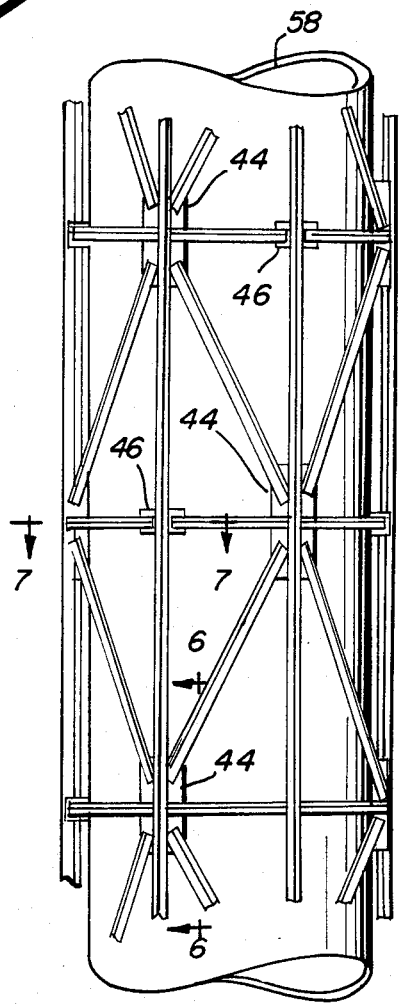

CHIMNEY LINING SYSTEM INCLUDING FRAME-SUPPORTED MEMBRANE

BACKGROUND OF THE INVENTION

In the art of industrial chimney manufacture, the use of alloy materials to resist corrosion has become more acceptable in recent years, in spite of the relatively high costs associated with such materials.

For the past several years, electric utilities and other industries in the U.S. have been required by law to reduce the amount of sulfur dioxide and other recognized pollutants emitted by their activities. One method to capture sulfur dioxide is the use of wet lime or limestone scurbbers. However, the use of these systems produces a wider range of chimney operating conditions ranging from low temperature, highly acidic, to alkaline at high temperatures. Alloy materials such as Alloy 625 and some stainless steels have been recognized as providing superior corrosion resistance to the broad spectrum of operation encountered downstream of FGD systems. However, the cost of alloy materials is prohibitive.

The present inventor is a joint inventor named in the U.S. Pat. No. 4,265,166, of Parker et al issued May 5, 1981, which patent relates to a chimney lining system which can utilize the superior corrosion resistance of alloy steels in scrubbed flue gas environment without using a heavy, very expensive alloy plate. The Parket et al system is particularly directed toward retrofit projects where the membrane would be installed within an existing steel lining. The system requires the use of flexible suspenders which permit radial expansion and uses horizontal corrugations for axial expansion. The resulting annulus between the membrane and the steel lining is subject to a partial vacuum pressure to enable the membrane to resist negative pressure and potential implosions within the chimney. Considered in the wider realm of industrial chimney manufacture, use and maintenance, the Parker et al system can be seen to possess certain disadvantages or shortcomings, including:

(a) The horizontal corrugation providing axial expansion protrudes into the gas stream and, as a consequence, is subject to erosion.

(b) The use of a partial vacuum pressure to resist negative pressure and implosions facilitates entry of contaminants into the annulus which will accelerate corrosion if cracks or holes occur. The vacuum pressure may also require additional stiffening on the exterior of the existing lining.

(c) Once installed, the membrane cannot be serviced or inspected since it is hidden by the presence of the existing steel liner.

(d) The system is not readily adaptable to new construction.

SUMMARY OF THE INVENTION

A chimney lining system is disclosed, in which a membrane, typically 60 mils thick, of corrosion-resistant alloy material is suspended within an external skeletal frame-work of less-expensive carbon steel. Hangers provide for radial expansion of the liner. However inward movement of the hangers is restrained. Axially spaced circumferential corrugations located midway axially between where two membrane sections are stiffened, joined and connected to the framework, provide for axial expansion. The external framework is disposed within a tubular concrete chimney column. At several levels, grillages support the external framework from the wall of the chimney column. The structural grillages may bear upon load cells equipped to signal the build-up of sludge on the interior of the liner.

The principles of the invention will be further discussed with reference to the drawings wherein a preferred embodiment is shown. The specifics illustrated in the drawings are intended to exemplify, rather than limit, aspects of the invention as defined in the claims.

BRIEF DESCRIPTION OF THE DRAWINGS

FIG. 3 is a transverse sectional view taken on line 3—3 of FIG. 2.

FIG. 4 is a fragmentary elevational view of a portion of the liner; and

FIG. 5 is a fragmentary elevational view of the comparable portion of the support frame/liner assembly, with the liner shown in more rudimentary detail in this view for the sake of clarity in illustration of the support frame.

(FIG. 3, which is drawn to a larger scale would fall in this series between FIGS. 10 and 11 in this series.)

DETAILED DESCRIPTION

Figure 1A:
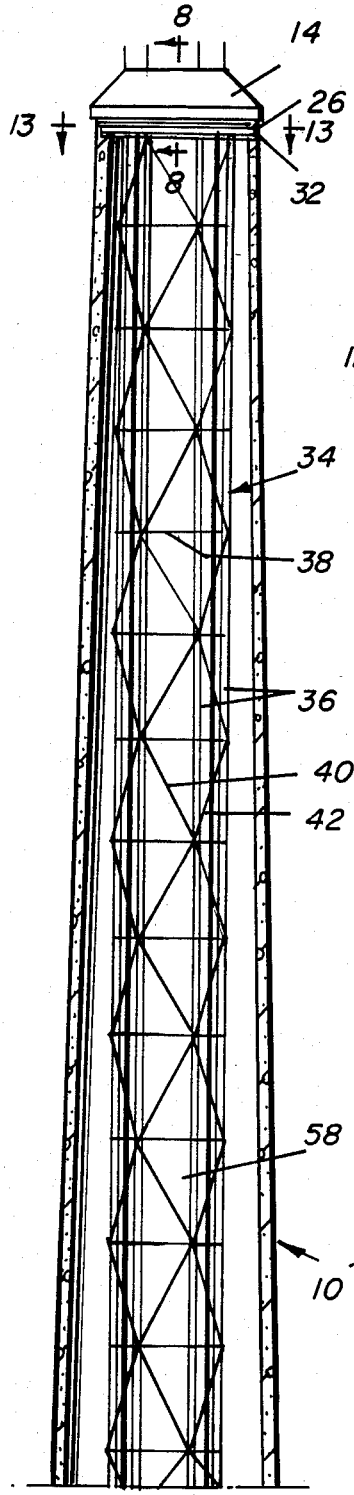
FIGS. 1A, 1B and 1C provide in three segments a longitudinal sectional view of a chimney column provided with a frame-supported membrane in accordance with principles of the present invention.
Figure 1B:
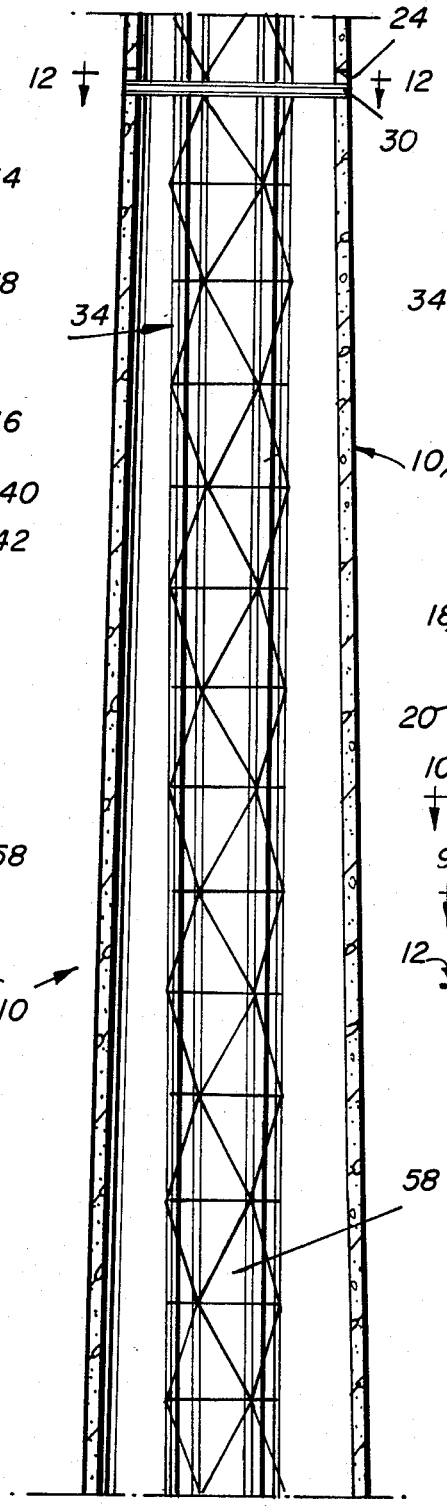
Figure 1C:
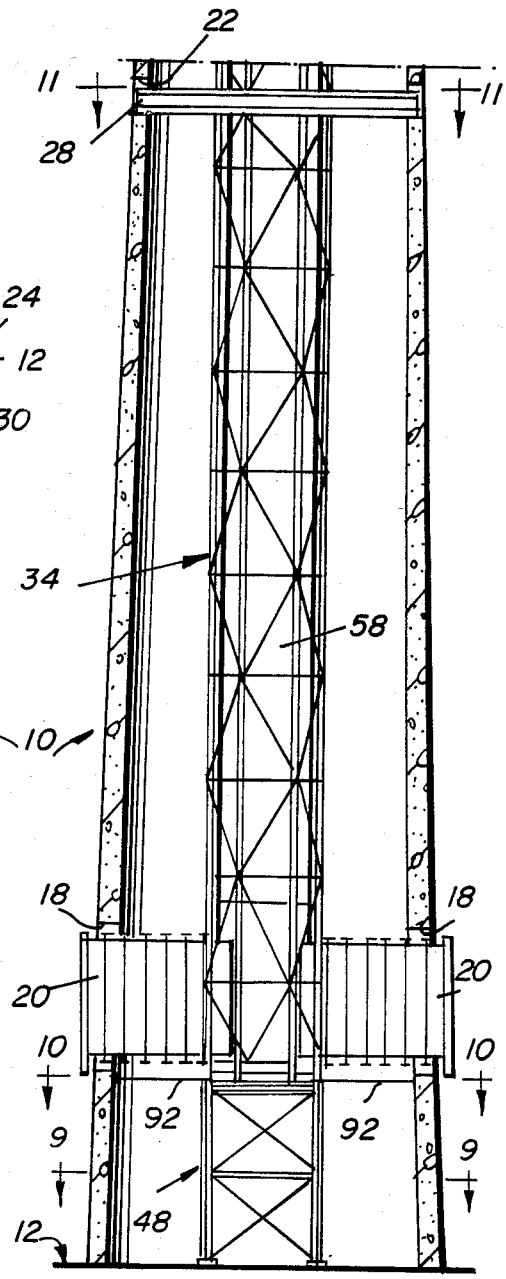
Figure 8:
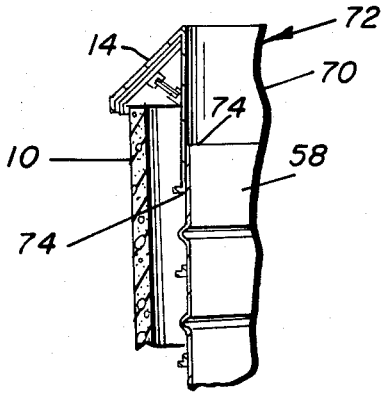
FIG. 8 is a fragmentary longitudinal sectional view of the upper end region of the construction, taken on line 8—8 of FIG. 1, and drawn to the scale of FIGS. 2–5.
Figure 9:
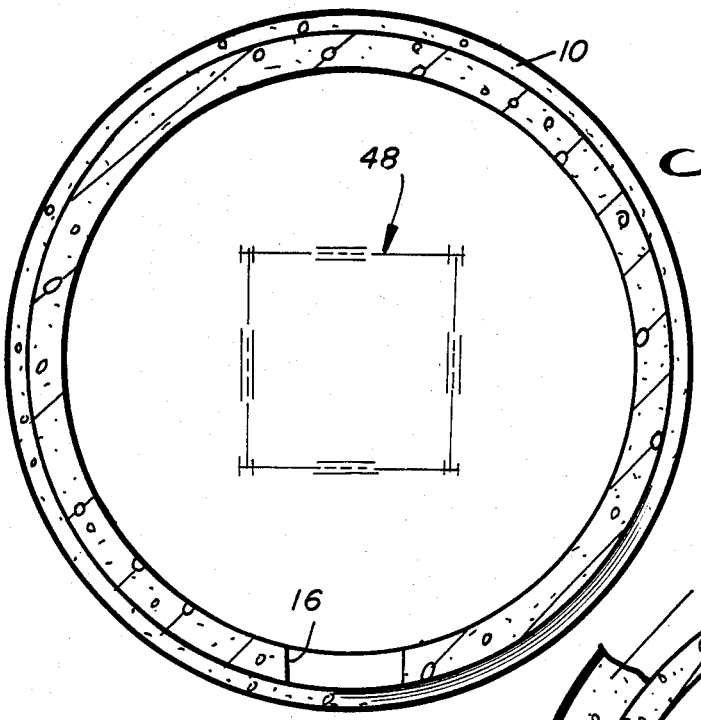
FIGS. 9–13 are somewhat diagrammatic transverse sectional views of the construction shown in FIG. 1, taken at levels 9—9, 10—10, 11—11, 12—12 and 13—13 indicated in FIG. 1.

A typical modern industrial chimney column cast in place of concrete is shown at 10 in FIG. 1. Typically, from the top of the foundation at 12 to the top of the rainhood 14 (neglecting the height of the lightning-protection air terminals), the chimney measures eight hundred feet in height, is sixty-eight and two-thirds feet in outside diameter at the base. The concrete column tapers to twenty-seven feet in outside diameter at the top, with the rainhood being thirty and two-thirds feet in diameter. (The rainhood 14 is mounted to the liner as illustrated in FIG. 8.)

The typical chimney column 10 as shown is distinguished by an access hatch 16 next to the base, two diametrically opposed openings 18 for breeching 20, e.g. beginning at the thirty-nine foot level, for twenty-three by eight foot breeching, and a plurality of symmetrically placed openings 22, 24, 26 at the two hundred-thirty, five hundred-ten, and seven hundred-ninety foot levels for supporting support grillages 28, 30, 32. The openings 22, 24, 26 are shown closed on the outside by removable hatch covers 25.

Figure 2:
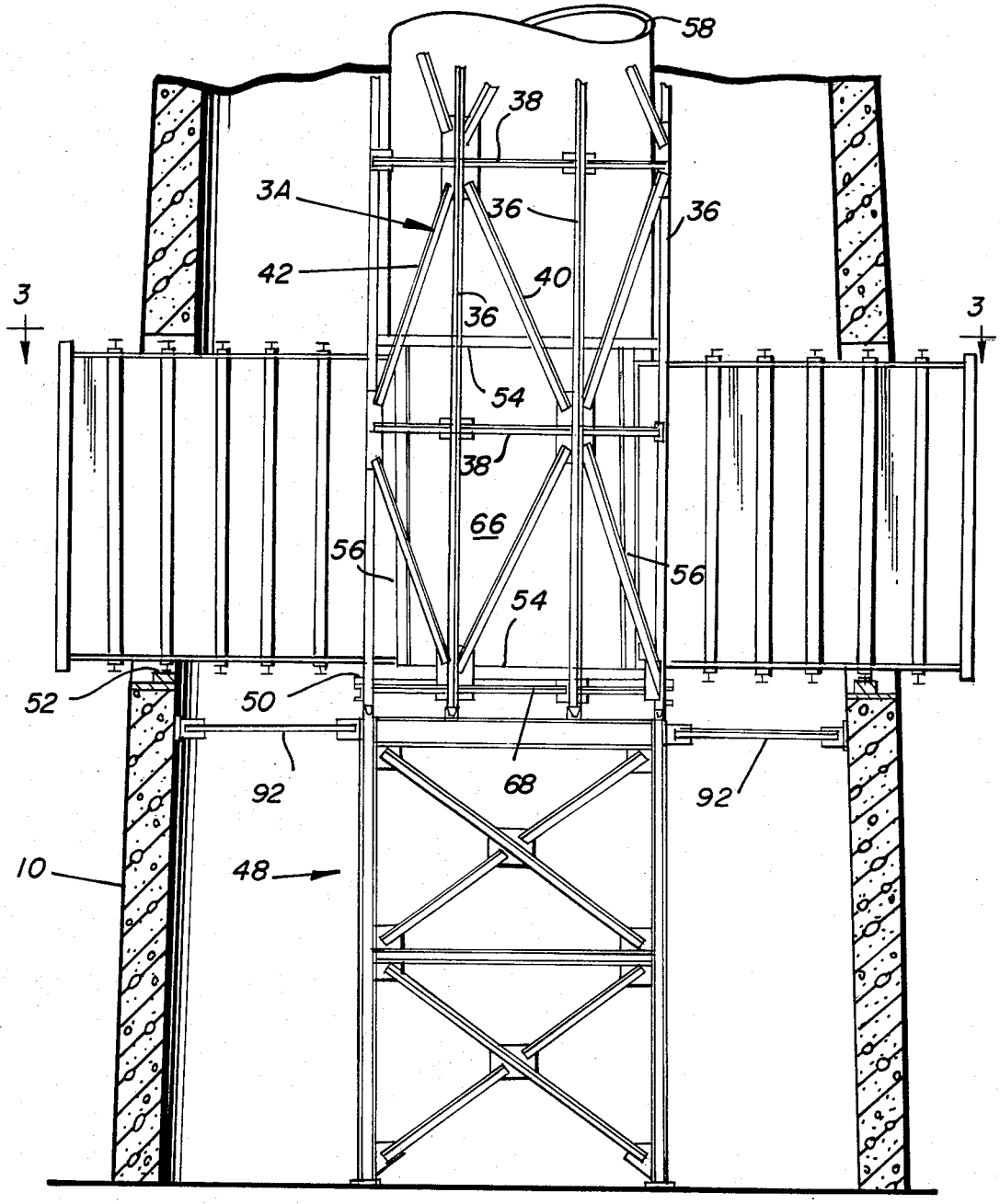
FIG. 2 is an enlargement showing additional details of the portion shown within the labeled chain-dot perimeter drawn on FIG. 1C.

A tubular, largely open framework 34, typically fabricated of box-channel vertical legs 36, L-channels secured together back-to-back to form T-shaped horizontal and opposing spiral members 38, 40, 42 sandwiched about gusset plates 44 where oppositely spiraling struts 40, 42 cross a horizontal strut 38, and gusset plates 46 where horizontal struts cross vertical legs 36. As shown, at each level of the framework 34 above the breeching, gusset plates 44 and 46 alternate with one another around the circumference, with the series being staggered by one gusset plate from level to level. Typically, the distance between levels is twenty feet and there are eight vertical legs 36 spaced forty-five degrees apart around the circumference of the frame. Accordingly, each series of spiralling struts 40 and 42 takes eight levels to complete one turn about the circumference of the frame. Characteristically, the framework 34 is very open. A somewhat different arrangement 48 of struts and legs is indicated at the base of the frame and around the breeching, as illustrated in FIGS. 2 and 3. Fixed supports for the breeching are provided at 50, sliding supports at 52, and perimetrically-extending respective stiffener plates at 54, 54, 56 and 56.

The liner support frame 34 typically is fabricated of three-eights inch carbon steel plates, ASTM A36, bolted, riveted and/or welded together at the job site.

The liner 58 is a tubular member fabricated, for the xost part, of thin (typically sixty-mil-thick) corrosion resistant alloy (e.g. ASTM B443) sheet formed as individual panels 60 each about six feet in finished height and circularly arcuate through one hundred-twenty degrees about a vertical axis, with a ten foot radius of curvature (not counting the external ribs 62). The three panels 60 at each level are fabricated together, e.g. by butt welding along vertical seams 64, which are staggered by sixty degrees, i.e. half a panel length, from level to level. Each panel, half-way up its height is shown provided with an externally concave/internally convex rolled rib 62 in the nature of a corrugation, to provide a circumferentially extending/vertically-active expansion joint for each level. Each rib 62 typically protrudes two inches, is one and one-half inches high, is concavely radiused at its bases and convexly radiused at its radially outer extent.

At the lower end, the liner 58 is shown provided with a hollow cylindrical portion, e.g. thirty-one feet in height, made of the same alloy as the panels 60, but thicker, e.g. three-sixteenths or about a one-quarter of an inch thick. The lower end sub-assembly 66 includes transition intersections with the breeching 20, where the stiffeners 56 are provided, typically one-half inch by ten inch vertical plates, and at the bottom and top where stiffeners 54 are perimetrically provided, typically WT 6X26, both ASTM A36 carbon steel plate. The sub-assembly 66 includes a lower end wall 68 of the same corrosion-resistant alloy plate as the sidewall thereof.

At the upper end, the liner 58 is shown provided with a cylindrical portion 70, e.g. ten feet in height, made of the same alloy material as the lower end sub-assembly 66. The rainhood 14 is mounted to the cylindrical portion 70 typically as shown in FIG. 8, to provide an upper end sub-assembly 72.

The lower end sub-assembly and upper end sub-assembly typically are telescoped over the lower and upper ends of the main thin membrane portion of the liner 58 and circumferentially welded inside and out at the respective seams 74.

The upper and lower edges of the panels 60 in each level of the liner are butt welded to the corresponding edges of the panels in the next upper and next lower levels at seams 76. Circumferentially extending L-brackets 78 also are welded externally to the liner 58 with a respective radially inner flange 80 of each bracket covering a respective seam 76. The brackets 78 act as stiffening hoops for the membranous liner 58 and also to provide anchor points for connecting the liner to the framework 34 so as to support the liner 58 from the framework 34.

Typically, at each place where the horizontal, radially extending outer flange 82 of a bracket 78 is radially and axially in line with the inner face of a square-sectioned tubular leg 36 of the liner support frame 34, a square-sectioned, radially extending arm 84 is provided so as to have its radially outer end welded to the inner face of the leg at 86 and its radially inner end provided with a flange having a radially elongated vertical slot provided therethrough at 88. Each such slot is typically nine-sixteenths inch wide by one and seven-eighths inch long. A corresponding round hole is formed vertically through the bracket 78 horizontal flange 82, a pad of stiffly resilient, somewhat lubricous bearing material such as a Teflon polytetrafluorethylene pad with a round hole through it is sandwiched between the inner end flange of the arm 84 and the flange 82 and a nut and bolt assembly 90 is secured through the aligned slot and hole, to finger-tightness, and a cotter pin is installed through the bolt shank to prevent loosening and loss of the nut.

The rainhood 14 and circumferential brackets 78 may be made of the same alloy as the liner 58, e.g. ASTM B443.

Although the weight of the liner 58 must be transferred to the support frame 34 at frequent intervals because the liner is so relatively insubstantial in structural strength, the liner support frame needs far less numerous individual support points. The weight of the lowest section of the support frame 34, i.e. all below the grillage 28 is carried on the foundation at the base of the frame 34, with part of the weight of the breeching being carried at 52. The weight of the support framework also is carried to the concrete shaft 10 at the levels of the grillages 28, 30 and 32. The base arrangement 48 of the framework is also secured to the cement shaft 10 just below the breeching, at 92.

Figure 10:
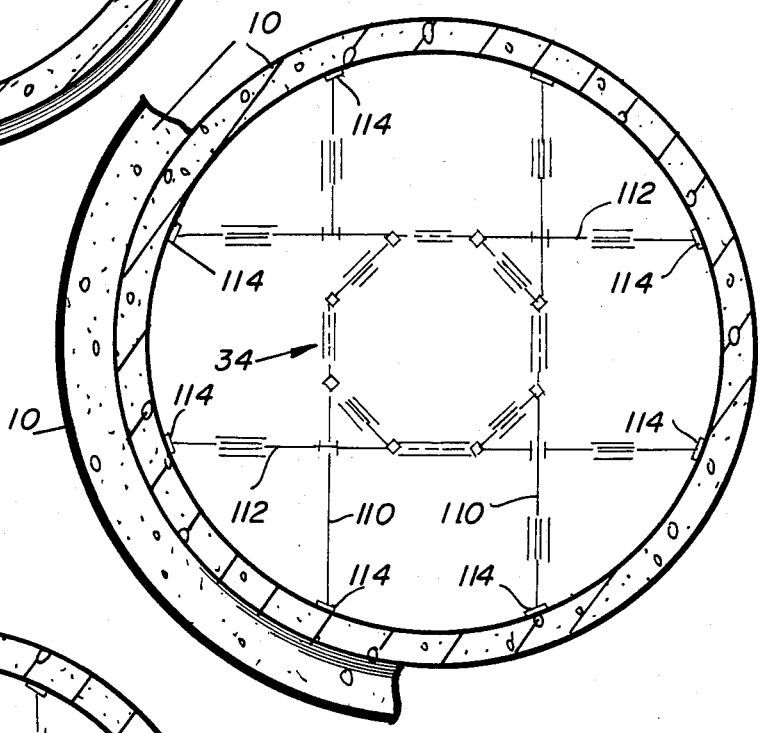
Figure 11:
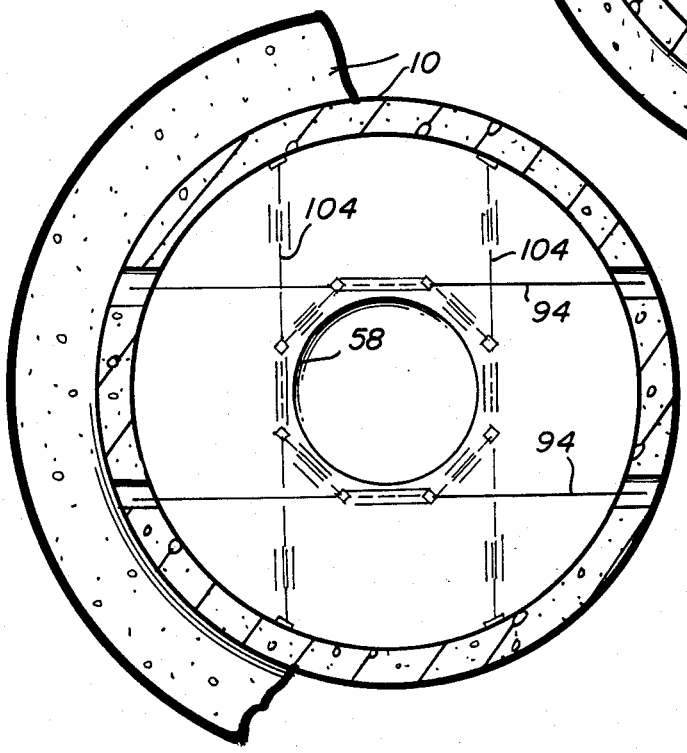
Figure 12:
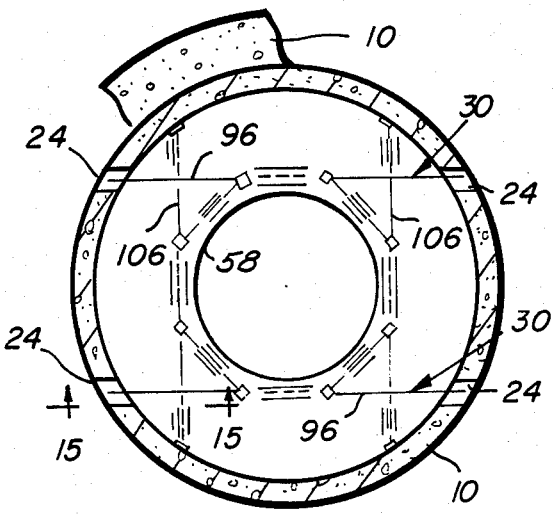
Figure 13:
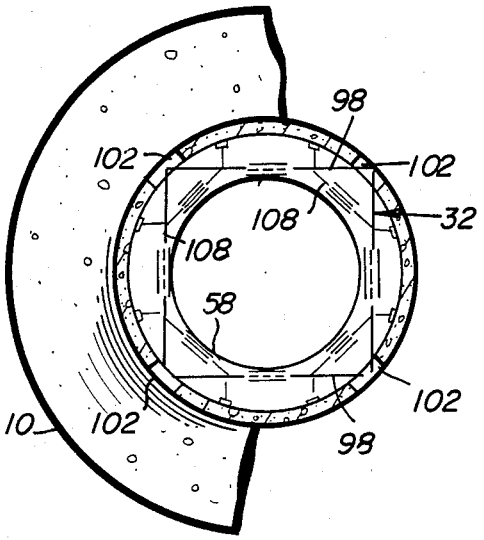

At each of the grillage levels shown in FIGS. 11, 12 and 13 there are two horizontal, parallel I-beams 94, 96, 98 respectively tangent to the liner support frame 34 at diametrically opposed sides, so as to intersect four respective legs of the liner support frame. The opposite ends of the beams 94, 96, 98 rest on piers 100 mounted on the ledges 102 in the respective openings 22, 24, 26. At the level of the grillages 28, 30, and 32, a second pair of parallel beams 104, 106, 108 crosses the first at right angles and is tangent to another opposed pair of sides, so as to intersect the other four respective legs of the liner support frame. A similar set of two pairs of crossed interconnected beams 110, 112 is provided at the sub-breeching level shown in FIG. 10.

Figure 14:
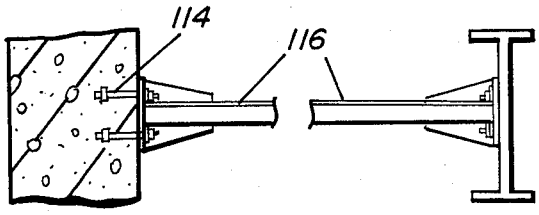
FIG. 14 is a fragmentary longitudinal sectional view taken on line 14—14 of FIG. 11 but drawn to the larger scale of FIG. 6.

At the level shown in FIG. 10 both pairs of beams 110, 112 are anchored at the ends to the wall of the shaft 10 from the inside, e.g. using anchor bolts 114 at outer ends of ties 116 constituted by paired L-brackets welded together as T's having their inner ends appropriately welded to the respective beam or to the frame 34 near its intersection with the respective beam. Similar ties are provided at the levels shown at 116 in FIGS. 11, 12 and 13. The details of a representative tie 116 are shown in FIG. 14.

At the upper most grillage level shown in FIG. 13, the two pairs of I-beams 98, 108 are arranged in a square, so that the comparable ends of two I-beams which extend at right angles to one another rest on the same pier 100 on the same ledge 102.

Figure 15:
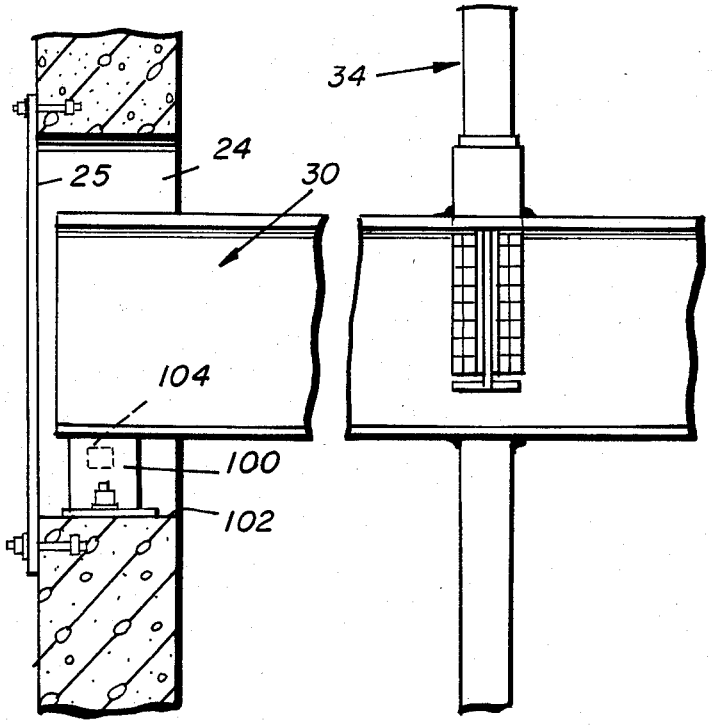
FIG. 15 is a fragmentary longitudinal sectional view taken on line 15—15 of FIG. 12, but on the same scale as FIG. 14.

The beam-on-pier connections typified by the one illustrated in FIG. 15 primarily bear a portion of the weight of the liner support frame 34 and liner 58 associated therewith. The tie-to-anchor connections typified by the one illustrated in FIG. 14 are primarily for maintaining the frame/liner assembly centralized in the chimney column. The two types of connections are preferably evenly distributed, alternating with one another, i.e. having their series intercalated at the various levels, as illustrated in FIGS. 10, 11, 12 and 13.

The piers 100 preferably incorporate load cells 104, as indicated, in order that the potential increase in weight at any grillage level can be monitored. An increase in weight can be interpreted to indicate that sludge or other waste is building up on the inside of such portion of the liner as is supported from that grillage. These load cells 104, the instrumentation thereof and the manner in which they are coupled to the respective grillages is otherwise conventional.

Sometimes herein the liner 58 is referred to as a "membrane"; this is not to imply that its wall is intentionally pervious, or semipervious to any solid, liquid or gas in either direction, for it is intended to be gas-tight. The sole implication of "membrane" as used, is that the liner, at typically 60 mils thick, is very thin in comparison with what would be necessary for a free-standing, implosion-proof liner.

What the invention provides for an industrial chimney, e.g. a tall tubular, conical column of concrete, is tubular liner membrane of corrosion-resistant, expensive material such as a high nickel alloy that is supported axially and against radial collapse by an external open framework made of a strong, less expensive (usually less corrosion resistant) material, such as carbon steel plate generally fabricated by welding. The structural frame is, in turn, suspended at the base on the chimney foundation, and from grillages which are supported from the chimney column. The membrane is supported from the frame at regular intervals. The spacing of the intervals is determined by evaluating the effect the temperature and pressure of the gas being vented has on the liner material. Axial expansion is accommodated by the formed horizontal corrugations in the liner; these corrugations are formed midway between support levels. Radial expansion of the liner relative to the liner support frame is accommodated by slots and lubricous bearing pads where the liner is supported from the liner support frame. Resistance to local circumferential buckling of the liner is provided by the corrugations, and by ring-shaped stiffeners secured to the liner over the circumferential butt joints between levels of panels of the liner. Additional resistance is provided by the liner support frame, due to its multiplicity of well-distributed connections to the membrane at the support points. Because the ring-shaped stiffeners are provided at the horizontal joints, during field butt welding of the panels at these joints, the ring-shaped stiffeners function as back-up bars.

Figure 16:
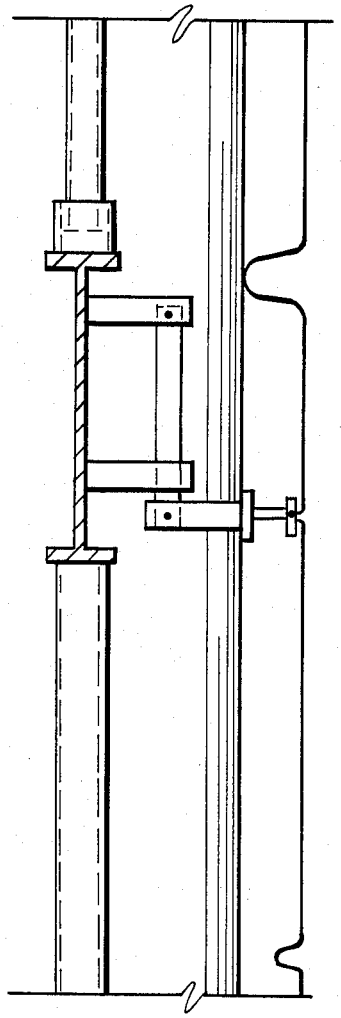
FIG. 16 is a fragmentary longitudinal sectional view of the liner showing the typical additional specially-designed expansion joint provided directly above each grillage support.

Especially where the chimney liner system will be subjected to higher elevated temperatures, an additional expansion joint should be provided for the liner 58 directly above the level of each grillage. A specially-designed expansion joint for this purpose is typically illustrated at 120 in FIG. 16.

Figure 17:
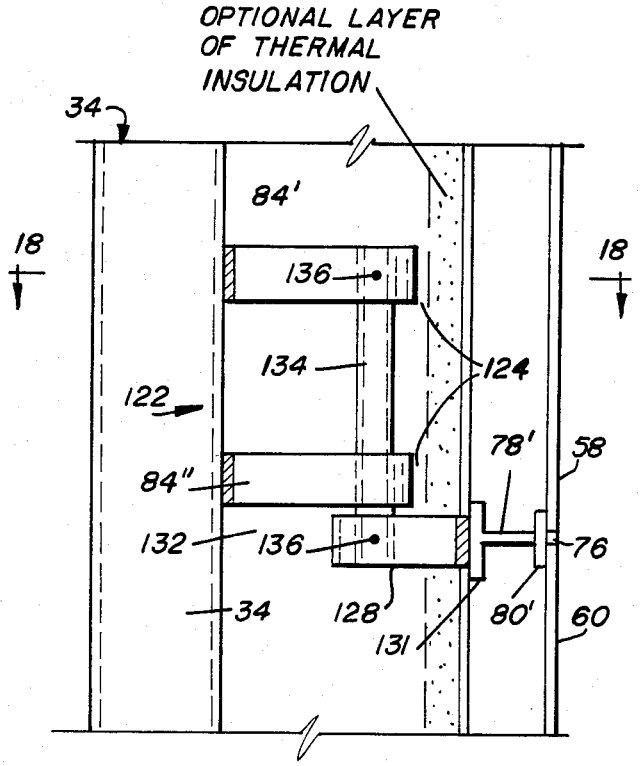
FIG. 17 is a fragmentary longitudinal sectional view similar to FIG. 6, but showing a modified hanger construction for hanging the liner from the structural frame.
Figure 18:
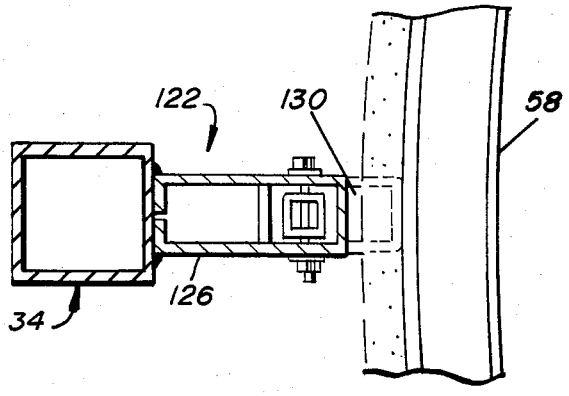
FIG. 18 is a fragmentary transverse sectional view taken on line 18—18 of FIG. 17.

There is shown in FIGS. 17 and 18, a hanger 122 for connecting the liner 58 to the structural frame 34. Hangers 122 can be used in place of respective ones of any or all of the connectors 78–90, which have been described hereinbefore in relation to FIGS. 6 and 7.

In FIGS. 17 and 18, the seam 76 where the upper edge of a lower panel 60 is welded to the lower edge of an upper panel is externally covered by the inner flange 80' of a welded-in-place, circumferentially extending stiffener 78' having a modified I-shaped transverse cross-sectional figure.

At each hanger 122, two vertically, axially short brackets 84', 84'' are mounted, e.g. by welding, to the inner face of the respective leg 36 of the structural support 34. Each bracket 84', 84'' extends horizontally, radially towards the liner 58, but terminates short of the liner 58 so as to leave gaps 124 between the brackets 84', 84'' and the liner 58. The brackets 84', 84'' are vertically spaced a short distance from one another but superimposed so that the slots 126 are in vertical registration. Each slot 126 thus is elongated radially inwardly toward the liner 58 from the leg 36 on which it is mounted.

A similar vertically, axially short bracket 128 is mounted on the radially outer flange 131 of the stiffener 78, e.g. by welding, so as to extend horizontally, radially towards the leg 36. The vertical slot 130 through the bracket 128 is in vertical registry with the slots 126 and is elongated radially outwardly toward the leg 36. The bracket 128 is shorter in the radial direction than are the brackets 84', 84'', leaving a larger gap at 132 than the gaps 124. A hanger 134 in the form of a short section of box channel is inserted through all three aligned slots 126, 126 and 130, and is laterally, horizontally pivotally pinned near its upper and lower ends respectively to the upper bracket 84' and the bracket 128, e.g. by respective nut and bolt assemblies 136. Preferably the disposition of the brackets, slots and pivots relative to one another, as shown, are such as to prevent substantial inward movement of the liner 58 from the structural support 34 from the datum location shown, to prevent substantial angular rotational movement of the liner 58 relative to the support 34, but permit a greater degree of radial expansion of the liner 58 towards the structural support 34 from the datum location shown (and respective contraction back to the datum location).

Figure 6:
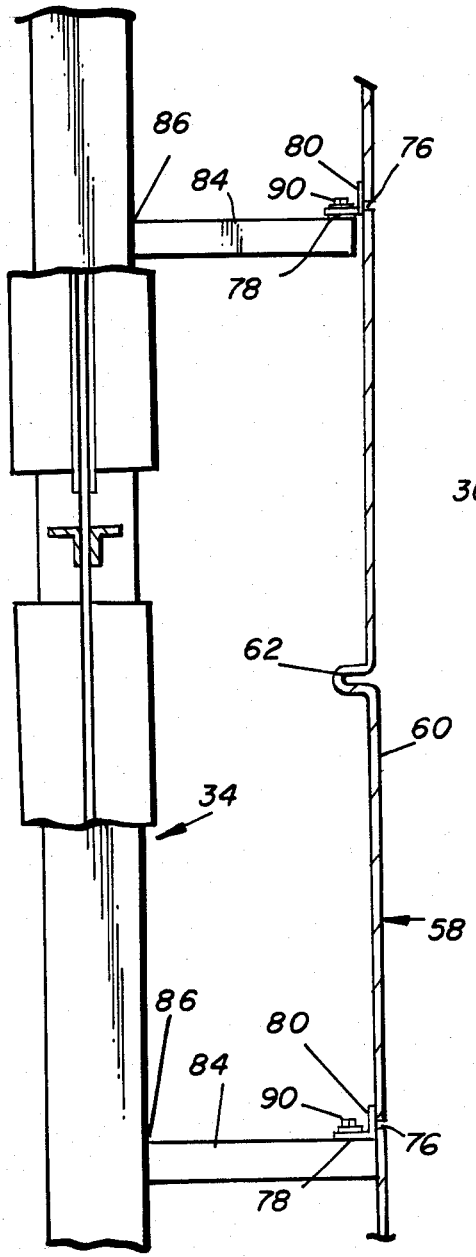
FIG. 6 is a further-enlarged-scale fragmentary longitudinal sectional view of the support frame/liner assembly taken on line 6—6 of FIG. 5.
Figure 7:
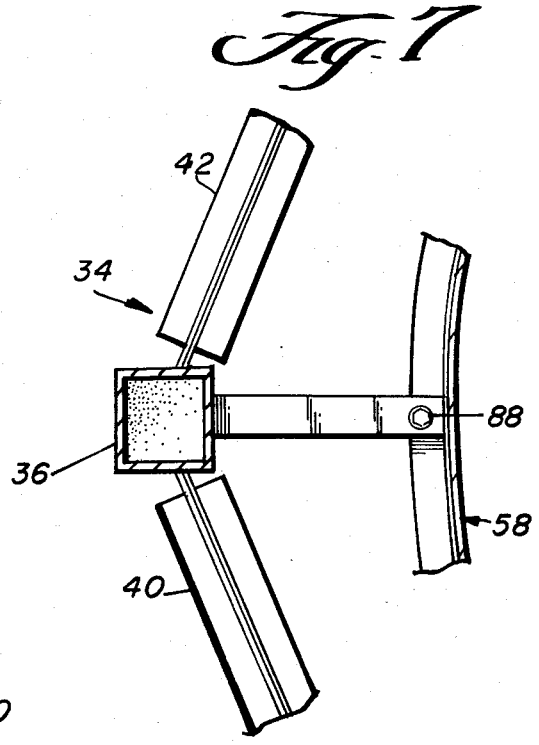
FIG. 7 is a fragmentary transverse sectional view thereof taken on line 7—7 of FIG. 5.

The form of hanging means shown in FIGS. 17 and 18 currently is preferred over the form of hanging means shown in FIGS. 6 and 7, the one shown in FIGS. 17 and 18 presently being believed to be easier to install, by field welding and bolting, and because it provides a more positive means for permitting radial expansion, offers a greater resistance to implosion and earthquake shear, and is considered to be more reliable in operation.

Because the chimney column 10 may be basically conventional but for the accommodations shown for supporting the structural framework 34, the subcombination of the liner with the structural framework may itself be considered to be an improvement.

When a chimney column is provided with a frame-supported corrosion-resistant liner in accordance with the principles of the present invention, the chimney is given superior resistance to corrosion. The same basic design can be used in a variety of situations where there are wide variations in operating temperatures. The liner is light in weight, yet the liner/frame assembly has an excellent structural capacity. No pressurization system is needed for the annulus between the chimney column and the liner, nor between the chimney column and the frame, nor between the frame and the liner. Indeed, the frame is largely open work so that the liner may be inspected and maintained without requiring a plant shut-down.

It should now be apparent that the chimney lining system including frame-supported membrane as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. For lining a chimney comprising a massive tubular columnar shaft, fixed upright on a foundation, a system comprising:

an upright gas-tight tubular liner made of thin, corrosion-resistant material, said liner including a plurality of axially spaced circumferential corrugations for accommodating axial expansion and contraction of the liner;

a relatively open skeletal framework that generally coaxially surrounds the liner throughout substantially the whole of the height of the liner;

generally radially extending means mechanically connecting the liner to the framework at a large plurality of axially and angularly distributed sites, these mechanically interconnecting means including means for accommodating radial expansion and contraction of said liner while preventing implosion of the liner;

said framework being arranged to be supported at least indirectly on said foundation, to extend within the chimney column, and being so open as to permit visual inspection of the liner from externally of the framework.

2. The chimney lining system of claim 1, wherein:

the framework is made of carbon steel and the liner is made of corrosion resistant alloy.

3. The chimney lining system of claim 1, wherein:

the liner is made of a plurality of circularly arcuate panels butt seamed end-to-end within levels, and circumferentially butt seamed edge-to-edge from level-to-level;

further comprising:

a stiffener ring externally backing-up each such circumferential butt seam.

4. The chimney lining system of claim 3, wherein:

the panel edges are butt welded together and welded to the stiffener rings; and the mechanically interconnecting means connect the framework with the stiffening rings.

5. The chimney lining system of claim 4, wherein:

each panel of said liner has one such corrugation, extending horizontally thereacross substantially midway between the upper and lower edges thereof.

6. The chimney lining system of claim 1, wherein:

the liner further includes an upper end tubular portion mounting a rainhood and a lower end tubular portion having a breeching conduit intersecting generally horizontally therewith.

7. The chimney lining system of claim 6, wherein:

the liner is made of a plurality of circularly arcuate panels butt seamed end-to-end within levels, and circumferentially butt seamed edge-to-edge from level-to-level;

further comprising:

a stiffener ring externally backing-up each such circumferential butt seam.

8. The chimney lining system of claim 7, wherein:

the panel edges are butt welded together and welded to the stiffener rings; and the mechanically interconnecting means connect the framework with the stiffening rings.

9. The chimney lining system of claim 8, wherein:

each panel of said liner has one such corrugation, extending horizontally thereacross substantially midway between the upper and lower edges thereof.

10. The chimney lining system of claim 6, wherein:

the liner, except for the upper end and lower end tubular portions thereof is made of corrosion-resistant steel alloy material that is on the order of about 60 mils thick, whereas the upper end and lower end tubular portions are made of substantially the same corrosion-resistant material that is on the order of about one-fourth inch thick.

11. The chimney lining system of claim 1, wherein:

the framework further includes a plurality of levels of grillage, each level of grillage having means for securing the grillage at that level to the massive tubular columnar shaft of the chimney.

12. The chimney lining system of claim 11, wherein:

the securing means for the grillage includes at each of a plurality of the levels of grillage both a first means constructed and arranged primarily for anchoring the framework at a plurality of symmetrically distributed first sites to the massive tubular columnar shaft and a second means constructed and arranged primarily for supporting the weight of a respective portion of the framework, and by the framework a respective portion of the liner, upon the massive tubular columnar shaft at a plurality of symmetrically distributed second sites.

13. The chimney lining system of claim 12, wherein:

at each such grillage level said first sites are interspersed with said second sites.

14. The chimney lining system of claim 12, wherein:

the second securing means of the respective grillage levels includes a plurality of generally horizontal beams each having a pier means at each end so that each pier means may bear upon a corresponding ledge provided on the massive tubular columnar shaft.

15. The chimney lining system of claim 14, wherein:

at least some of said pier means incorporate load cells means equipped to indicate an increase in the load on the respective pier means so that sludge build-up on the lining can be learned-of from externally of the chimney lining system.

16. A chimney comprising, in combination:

a massive tubular columnar shaft fixed upright upon a foundation; and a chimney lining system comprising:

an upright gas-tight tubular liner made of thin, corrosion-resistant material, said liner including a plurality of axially spaced circumferential corrugations for accommodating axial expansion and contraction of the liner;

a relatively open skeletal framework that generally coaxially surrounds the liner throughout substantially the whole of the height of the liner;

generally radially extending means mechanically connecting the liner to the framework at a large plurality of axially and angularly distributed sites, these mechanically interconnecting means including means for accommodating radial expansion and contraction of said liner while preventing implosion of the liner;

said framework being arranged to be supported at least indirectly on said foundation, to extend within the chimney column, and being so open as to permit visual inspection of the liner from externally of the framework.

17. The chimney of claim 16, wherein:

the framework is made of carbon steel and the liner is made of corrosion resistant alloy.

18. The chimney of claim 16, wherein:

the liner is made of a plurality of circularly arcuate panels butt seamed end-to-end within levels, and circumferentially butt seamed edge-to-edge from level-to-level;

further comprising:

a stiffener ring externally backing-up each such circumferential butt seam.

19. The chimney of claim 18, wherein:

the panel edges are butt welded together and welded to the stiffener rings; and the mechanically interconnecting means connect the framework with the stiffening rings.

20. The chimney of claim 19, wherein:

each panel of said liner has one such corrugation, extending horizontally thereacross substantially midway between the upper and lower edges thereof.

21. The chimney of claim 16, wherein:

the framework further includes a plurality of levels of grillage, each level of grillage having means for securing the grillage at that level to the massive tubular columnar shaft of the chimney.

22. The chimney of claim 21, wherein:

the securing means for the grillage includes at each of a plurality of the levels of grillage both a first means constructed and arranged primarily for anchoring the framework at a plurality of symmetrically distributed first sites to the massive tubular columnar shaft and a second means constructed and arranged primarily for supporting the weight of a respective portion of the framework, and by the framework a respective portion of the liner, upon the massive tubular columnar shaft at a plurality of symmetrically distributed second sites.

23. The chimney of claim 22, wherein:

at each such grillage level said first sites are interspersed with said second sites.

24. The chimney of claim 22, wherein:

the second securing means of the respective grillage levels includes a plurality of generally horizontal beams each having a pier means at each end so that each pier means may bear upon a corresponding ledge provided on the massive tubular columnar shaft.

25. The chimney of claim 24, wherein:

at least some of said pier means incorporate load cell means equipped to indicate an increase in the load on the respective pier means so that sludge build-up on the lining can be learned of from externally of the chimney lining system.

26. A frame-supported membrane for a chimney column, comprising:

an upright, gas-tight tubular membrane made of thin, corrosion-resistant material, said membrane including a plurality of axially spaced circumferential corrugations for accommodating axial expansion and contraction of the membrane;

a relatively open skeletal framework that generally coaxially surrounds the membrane throughout most of the height of the membrane;

generally radially extending means mechanically hanging the membrane from the framework at a large plurality of axially and angularly distributed sites, these hanging means including means for accommodating radial expansion of the membrane from a datum disposition and for accommodating contraction thereof back to that datum position, but for restricting further substantial contraction to prevent implosion of the membrane;

said framework being arranged to be supported at least indirectly upon afixed foundation, and being so open as to permit visual inspection of the membrane from externally of the framework.

27. The frame-supported membrane of claim 26, wherein:

the framework is made of carbon steel and the membrane is made of a more corrosion-resistant alloy.

28. The frame-supported membrane of claim 26, wherein:

the membrane is made of a plurality of circularly arcuate panels butt seamed end-to-end within levels, and circumferentially seamed edge-to-edge from level to level; and further comprising:

a stiffener ring externally reinforcing each such circumferential seam.

29. The frame-supported membrane of claim 28, wherein:

the panel vertical edges are butt welded together, and welded to the stiffener rings; and said mechanically interconnecting means connect the framework with the stiffening rings.

30. The frame-supported membrane of claim 29, wherein:

each panel of said membrane has one such corrugation, and that corrugation extends horizontally across the respective said panel generally midway between the upper and lower edges thereof.

31. The frame-supported membrane of claim 26, wherein:

the membrane further includes an upper end tubular portion mounting a rainhood and a lower end tubular portion having a breeching conduit intersecting generally horizontally therewith.

32. The frame-supported membrane of claim 26, wherein:

the framework further includes at least one intermediate level of grillage, each level of grillage having means for securing the grillage at that level to an external fixed support.

* * * * *